US012560371B2

(12) United States Patent
Zhang et al.

(10) Patent No.: US 12,560,371 B2
(45) Date of Patent: Feb. 24, 2026

(54) MAGNETIC FIELD FRESH-KEEPING APPARATUS CAPABLE OF PREVENTING DIRECT BLOWING OF COLD AIR AND AIR-COOLED REFRIGERATION DEVICE

(71) Applicants: QINGDAO HAIER REFRIGERATOR CO., LTD., Qingdao (CN); HAIER SMART HOME CO., LTD., Qingdao (CN)

(72) Inventors: Yuning Zhang, Qingdao (CN); Bin Fei, Qingdao (CN); Mengcheng Li, Qingdao (CN); Yao Yi, Qingdao (CN); Lisheng Ji, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 58 days.

(21) Appl. No.: 18/682,871

(22) PCT Filed: Jun. 22, 2022

(86) PCT No.: PCT/CN2022/100409
§ 371 (c)(1),
(2) Date: Feb. 9, 2024

(87) PCT Pub. No.: WO2023/016095
PCT Pub. Date: Feb. 16, 2023

(65) Prior Publication Data

US 2025/0020386 A1 Jan. 16, 2025

(30) Foreign Application Priority Data

Aug. 11, 2021 (CN) ..... 202110919191.1

(51) Int. Cl.
*F25D 17/08* (2006.01)
*F25D 25/02* (2006.01)

(52) U.S. Cl.
CPC ..... *F25D 17/08* (2013.01); *F25D 25/025* (2013.01); *F25D 2300/00* (2013.01)

(58) Field of Classification Search
CPC ..... F25D 25/025; F25D 23/00; F25D 21/04; A23B 2/60; H01F 29/12
See application file for complete search history.

(56) References Cited

U.S. PATENT DOCUMENTS 6,170,276 B1 1/2001 Mandel et al.
2007/0163291 A1 7/2007 Kim et al.
2017/0191731 A1* 7/2017 Djerekarov ..... F25D 17/067

FOREIGN PATENT DOCUMENTS

CN 101004311 A 7/2007
CN 203893531 U * 10/2014
(Continued)

OTHER PUBLICATIONS

Xiao (CN203893531U) English Translation (Year: 2014).*
Zuo et al. (CN108662832A) English Translation (Year: 2018).*

*Primary Examiner* — Elizabeth J Martin
*Assistant Examiner* — Keona Lauren Banks
(74) *Attorney, Agent, or Firm* — Muncy, Geissler, Olds & Lowe, P.C.

(57) ABSTRACT

A magnetic field fresh-keeping apparatus includes a drawer container, a drawer, a magnetic field assembly, an air inlet duct assembly, and an air return opening. An opening is provided at the front side of the drawer container; the drawer is slidably mounted in the drawer container; the magnetic field assembly is configured to provide a magnetic field to a stored item in the drawer; the air inlet duct assembly is configured to enable cold air to first cool the magnetic field assembly, and then enter the drawer container in a manner
(Continued)

of not directly blowing the stored item; the air return opening is formed on the drawer container for discharging the air in the drawer container.

2 Claims, 8 Drawing Sheets

(56) References Cited

FOREIGN PATENT DOCUMENTS

| | | | | |
|---|---|---|---|---|
| CN | 107436068 | A | 12/2014 | |
| CN | 205606993 | U | 9/2016 | |
| CN | 106338171 | A | 1/2017 | |
| CN | 106524642 | A | 3/2017 | |
| CN | 206291589 | U | 6/2017 | |
| CN | 108662832 | A | * 10/2018 | ..... F25D 11/02 |
| CN | 208579558 | U | 3/2019 | |
| CN | 111503985 | A | 8/2020 | |
| CN | 216114966 | U | 3/2022 | |
| CN | 216114967 | U | 3/2022 | |
| DE | 102009015751 | A1 | 10/2009 | |
| JP | 1995019716 | A | 1/1995 | |
| JP | 2003343961 | A | 12/2003 | |
| JP | 2008106994 | A | 5/2008 | |
| JP | 2014159896 | A | 9/2014 | |
| JP | 2015014423 | A | 1/2015 | |
| JP | 2017161129 | A | 9/2017 | |
| JP | 2018204876 | A | 12/2018 | |
| JP | 2020067212 | A | 4/2020 | |
| KR | 1020070024021 | A | 3/2007 | |
| KR | 20100085230 | A | 7/2010 | |
| KR | 1020100085230 | A | 7/2010 | |
| WO | WO9942771 | A1 | 8/1999 | |
| WO | WO2008153285 | A2 | 12/2008 | |
| WO | WO2020084864 | A1 | 4/2020 | |
| WO | WO2021070619 | A1 | 4/2021 | |

* cited by examiner

MAGNETIC FIELD FRESH-KEEPING APPARATUS CAPABLE OF PREVENTING DIRECT BLOWING OF COLD AIR AND AIR-COOLED REFRIGERATION DEVICE

TECHNICAL FIELD

The present invention relates to the field of food preservation technology, and in particular, to a magnetic field fresh-keeping apparatus and an air-cooled refrigeration device that prevents direct cold air blowing.

BACKGROUND

A theoretical study has demonstrated that magnetic fields have a significant impact on the formation of ice crystals during the freezing process, and being capable of lowering the freezing temperature of food materials.

In order to achieve the purpose of keeping food fresh at low temperature and not freezing, some manufacturers have equipped refrigeration devices (such as refrigerators) with electromagnetic coils to provide a magnetic field for food materials within the refrigeration devices.

However, the coils generate heat during operation, affecting the refrigeration effectiveness. Additionally, an existing air-cooled refrigeration device usually introduces cold air directly from a main air duct at the back panel into the drawer, thereby resulting in direct cold air blowing onto the food materials, which can still lead to freezing and not achieve the desired preservation effect.

SUMMARY

An object of the present invention is to provide a magnetic field fresh-keeping apparatus and an air-cooled refrigeration device that prevents direct cold air blowing onto food materials.

Another object of the present invention is to cool the magnetic field assembly with cold air, preventing the hot magnetic field assembly from affecting the preservation of the food materials.

Furthermore, a further object of the present invention is to make the cold air cool the magnetic field assembly first before cooling the food materials.

In particular, the present invention is directed to a magnetic field fresh-keeping apparatus capable of preventing direct blowing of cold air, applied to an air-cooled refrigeration device, comprising:

- a drawer container with an opening on a front side thereof;
- a drawer mounted in the drawer container in a slidable manner;
- a magnetic field assembly for providing a magnetic field to stored items inside the drawer;
- an air inlet duct assembly configured to enable cold air to first cool the magnetic field assembly, and then enter the drawer container in a manner of not directly blowing the stored item;
- an air return opening formed on the drawer container for discharging air in the drawer container.

Further, the magnetic field assembly is located outside the drawer container, and the magnetic field assembly comprises a top coil located on a top side and a bottom coil located on a bottom side of the drawer container.

Further, the air inlet duct assembly comprises:

- a top deflector plate covering the outside of the top coil, a top air duct formed between the top deflector plate and a top wall of the drawer container, the top air duct communicated with the drawer container; and
- a bottom deflector plate covering the outside of the bottom coil, a bottom air duct formed between the bottom deflector plate and a bottom wall of the drawer container, the bottom air duct communicated with the drawer container.

Further, an outlet of the top air duct aligns with a front cover of the drawer, thereby directing cold air towards the front cover, then redirecting it into the drawer; and/or,

- an outlet of the bottom air duct is formed on the bottom wall of the drawer container, thereby directing cold air to a bottom wall of the drawer.

Further, the air inlet duct assembly further comprises at least one side deflector plate set on at least one side of the drawer container, a side air duct is formed between each one of the at least one side deflector plate and the corresponding side wall of the drawer container, and the side air duct is communicated with the top air duct and/or the bottom air duct, each side air duct has a plurality of side outlets formed on the relative side wall of the drawer container, thereby directing cold air through the side outlets onto the side walls of the drawer.

Further, the air inlet duct assembly further comprises a guide duct arranged in a vertical direction, and the guide duct communicates with both the top air duct and the bottom air duct, the guide duct directs the cold air to the top air duct and the bottom air duct.

Further, the magnetic field assembly is located outside the drawer container and comprises left and right coils placed on the left and right sides of the drawer container respectively;

- the air inlet duct assembly comprises:
  - a left deflector plate covering the outside of the left coil and forming a left-side air duct between it and a left wall of the drawer container, and the left-side air duct communicated with the drawer container;
  - a right deflector plate covering the outside of the right coil and forming a right-side air duct between it and a right wall of the drawer container, and the right-side air duct communicated with the drawer container.

Further, a plurality of air outlets of the left-side air duct are formed on the left wall of the drawer container and aligned with the side panel of the drawer; and/or,

- a plurality of air outlets of the right-side air duct are formed on the right wall of the drawer container and aligned with the side panel of the drawer.

Further, the magnetic field assembly is located outside the drawer container and comprises front and rear coils, and the front coil is located on a front cover of the drawer and the rear coil is located on a rear side of the drawer container;

- the air inlet duct assembly comprises:
  - a front deflector plate covering the outside of the front coil and forming a front-side air duct between it and the front cover of the drawer, and the front-side air duct communicated with the drawer container.
  - a rear deflector plate covering the outside of the rear coil and forming a rear-side air duct between it and the rear wall of the drawer container, and the rear-side air duct communicated with the drawer container.

The present invention is also directed to an air-cooled refrigeration device, comprising a magnetic field-based fresh-keeping storage container as described above.

Based on the foregoing description, it is understood by a person skilled in the art that in the aforementioned technical scheme of the invention, by configuring the air inlet duct assembly to cool the magnetic field assembly with cold air first and then enter the drawer container in a non-direct blowing manner, it ensures that while cooling the magnetic field assembly, the cold air can also avoid direct blowing onto the stored items in the drawer (including food, medicines, beverages, biological reagents, colonies, chemical reagents, etc.), thereby preventing the stored items from freezing.

Furthermore, technical professionals would comprehend that if the cold air first flows through the drawer and then cools the magnetic field assembly, it would carry moisture from the drawer to the magnetic field assembly, causing corrosion. This invention overcomes this issue by directing the cold air to flow through the magnetic field assembly before moving to the drawer. Moreover, the magnetic field assembly can also heat the overly cold air, preventing the stored items in the drawer from freezing when the lower temperature air enters.

Additionally, by placing the magnetic field assembly on the outside of the drawer container, it avoids damage or scratches to the magnetic field assembly by the sliding drawer. By configuring the magnetic field assembly to include a top coil located at the top side and a bottom coil at the bottom side of the drawer container, it ensures a uniform magnetic field strength through the top and bottom coils, providing an optimal preservation environment for the stored items in the drawer.

Furthermore, by positioning the top deflector cover outside the top coil to form a top air duct between it and the top wall of the drawer container, and placing the bottom deflector cover outside the bottom coil to form a bottom air duct between it and the bottom wall of the drawer container, the top and bottom coils can be cooled separately in the respective air ducts.

Moreover, by designing the bottom air duct's outlet on the bottom wall of the drawer container, the cold air is directed to the bottom wall of the drawer, avoiding direct cold air blowing onto the stored items.

Additionally, by aligning the top air duct's outlet with the front cover of the drawer, the top air duct directs the cold air towards the front cover, which then redirects it inside the drawer. Alternatively, multiple micro-holes can be set on the top wall of the drawer container, allowing the top air duct to disperse the cold air through these micro-holes into the drawer container. Alternatively, at least a portion of the drawer container's top wall can be made of textile fabric, allowing the top air duct to disperse the cold air through the gaps in the fabric into the drawer container, avoiding direct cold air blowing onto the stored items.

Furthermore, the refrigerator can generate a magnetic field inside thereof, thereby enhancing the storage quality of the refrigerator and providing new preservation functions for smart refrigerators, meeting the increasing user demands for smart refrigerators and enhancing the quality of users' smart homes and intelligent living.

The above and other objects, advantages and features of the present invention will become more apparent to those skilled in the art from the following detailed description of specific embodiments thereof taken in conjunction with the accompanying drawings.

BRIEF DESCRIPTION OF THE DRAWINGS

Some specific embodiments of the invention will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

It should be understood by the person of ordinary skill in the art that the embodiments described hereinafter are only a part of the embodiments of the present invention and not all of the embodiments of the present invention, and that this part of the embodiments is intended to be used for explaining the technical principles of the present invention, and is not intended to be used for restricting the scope of protection of the present invention. Based on the embodiments provided in the present invention, all other embodiments obtained by a person of ordinary skill in the art without creative labor shall still fall within the scope of protection of the present invention.

It is to be noted that in the description of the present invention the terms "center", "top", "bottom", "top", "bottom", "left", "right", "vertical", "horizontal," "inside," "outside," and other terms indicative of directional or positional relationships are based on the directional or positional relationships shown in the accompanying drawings, which are for convenience of description only and do not indicate or imply that said device or element must have a particular orientation, be constructed and operated in a particular orientation, and therefore are not to be construed as a limitation of the present invention. Furthermore, the terms "first", "second", and "third" are used for descriptive purposes only and are not to be construed as indicating or implying relative importance.

Furthermore, it is to be noted that in the description of the present invention, unless otherwise expressly specified and limited, the terms "mounted", "connected", "connected" are to be understood in a broader sense, for example The connection may be a fixed connection, a removable connection, or a connection in one piece; it may be a mechanical connection or an electrical connection; it may be a direct connection or an indirect connection through an intermediate medium, or it may be a connection within the two elements. For a person skilled in the art, the specific meaning of the above terms in the present invention may be understood according to the specific circumstances.

Figure 1:
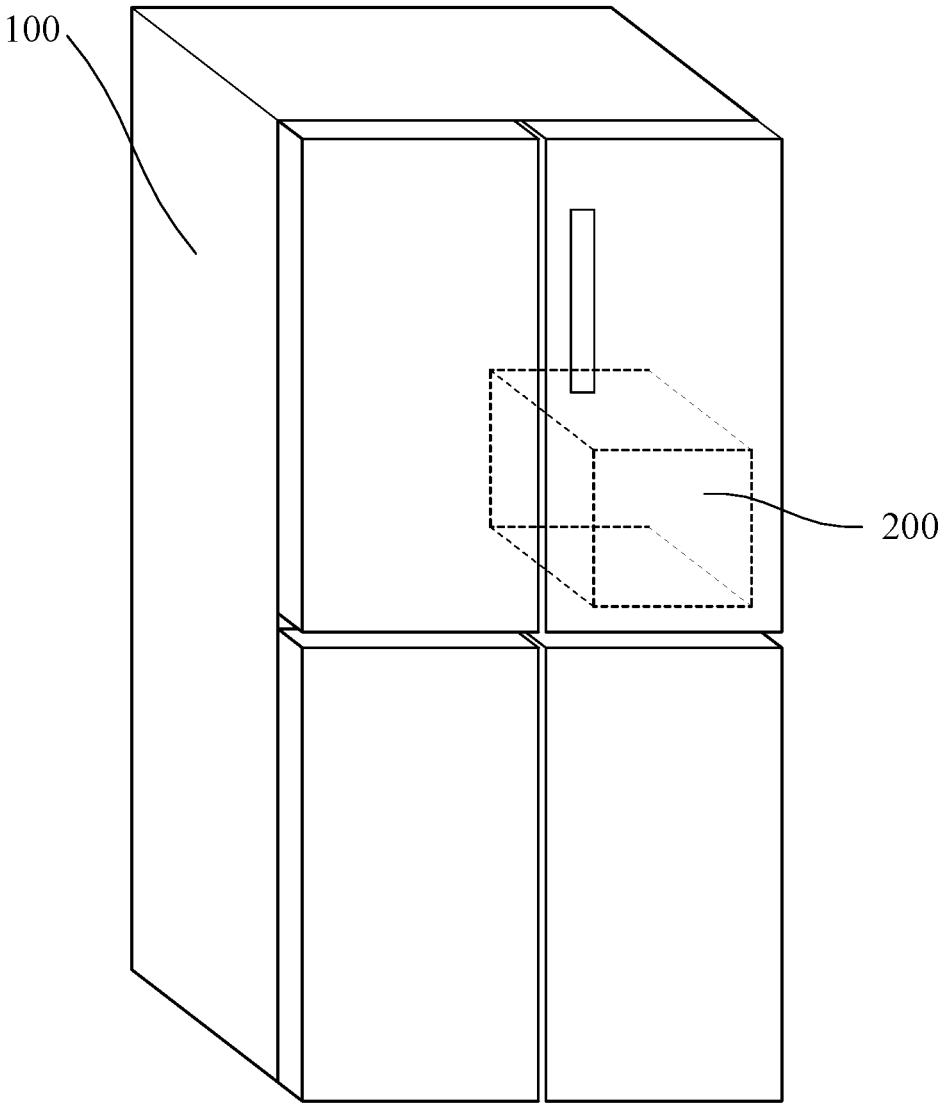
FIG. 1 is a schematic perspective view of an air-cooled refrigeration device according to some embodiments of the present invention.

FIG. 1 is a schematic perspective view of an air-cooled refrigeration device according to some embodiments of the present invention. The air-cooled refrigeration device comprises a cabinet body 100 and a magnetic field fresh-keeping apparatus 200. The magnetic field fresh-keeping apparatus 200 is installed on the cabinet body 100, and used for refrigeration and preservation of stored items (including food, medicine, beverages, biological reagents, colonies, chemical reagents, etc.).

In the present invention, the air-cooled refrigeration device can be a refrigerator, a freezer, or a cooler.

Figure 2:
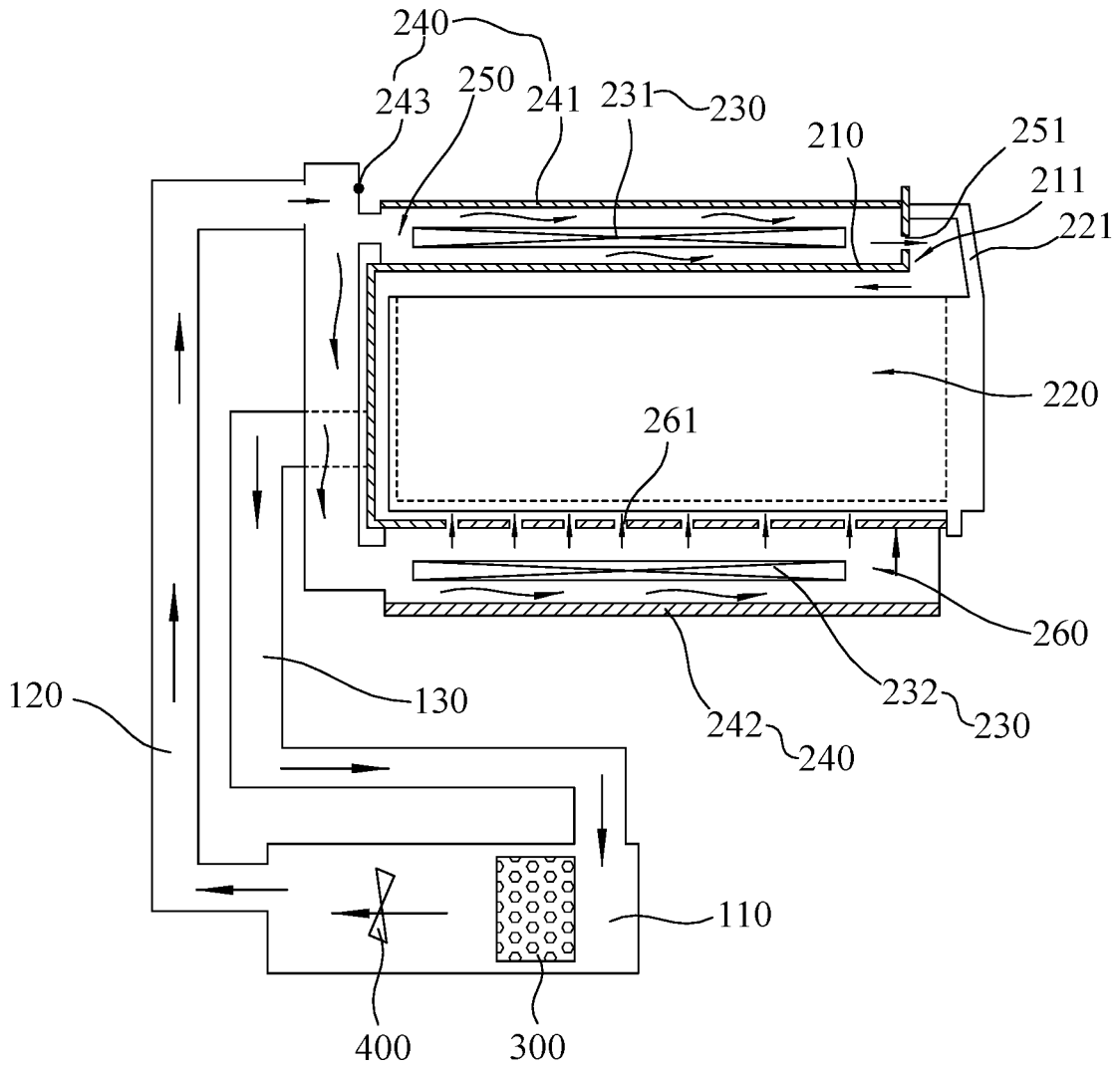
FIG. 2 is a principle schematic diagram of a magnetic field fresh-keeping apparatus in some embodiments of the present invention.

FIG. 2 is a principle schematic diagram of the magnetic field fresh-keeping apparatus 200 in some embodiments of the present invention.

As shown in FIG. 2, in some embodiments of the present invention, the cabinet body 100 comprises a refrigeration chamber 110, an air supply channel 120, a return air channel 130, and a storage chamber (not shown). The refrigeration chamber 110 and the storage chamber are interconnected through the air supply channel 120 and the return air channel 130, thereby allowing air to circulate between the refrigeration chamber 110 and the storage chamber. The magnetic field fresh-keeping apparatus 200 is arranged inside the storage chamber.

Furthermore, in some embodiments of this invention, the storage chamber can be singular or multiple. When there are a plurality of storage chambers, some are refrigeration chambers, some are variable temperature chambers, and some are freezer chambers. At least one magnetic field fresh-keeping apparatus 200 is arranged in the variable temperature chambers and/or freezer chambers.

Continuing with FIG. 2, in some embodiments of this invention, the air-cooled refrigeration device further comprises an evaporator 300 and a fan 400. The evaporator 300 is arranged inside the refrigeration chamber 110 and used for cooling the air inside the refrigeration chamber 110. The fan 400 drives the air to circulate in sequence through the refrigeration chamber 110, the air supply channel 120, the storage chamber, and the return air channel 130.

Continuing with FIG. 2, in some embodiments of this invention, the magnetic field fresh-keeping apparatus 200 comprises a drawer container 210, a drawer 220, a magnetic field assembly 230, and an air inlet duct assembly 240. The drawer 220 is installed in the drawer container 210 in a sliding manner for placing stored items. The magnetic field assembly 230 provides a magnetic field to the stored items inside the drawer 220. The air inlet duct assembly 240 is configured such that cold air first cools the magnetic field assembly 230 and then enters the drawer container 210 in a non-direct blowing manner.

Figure 3:
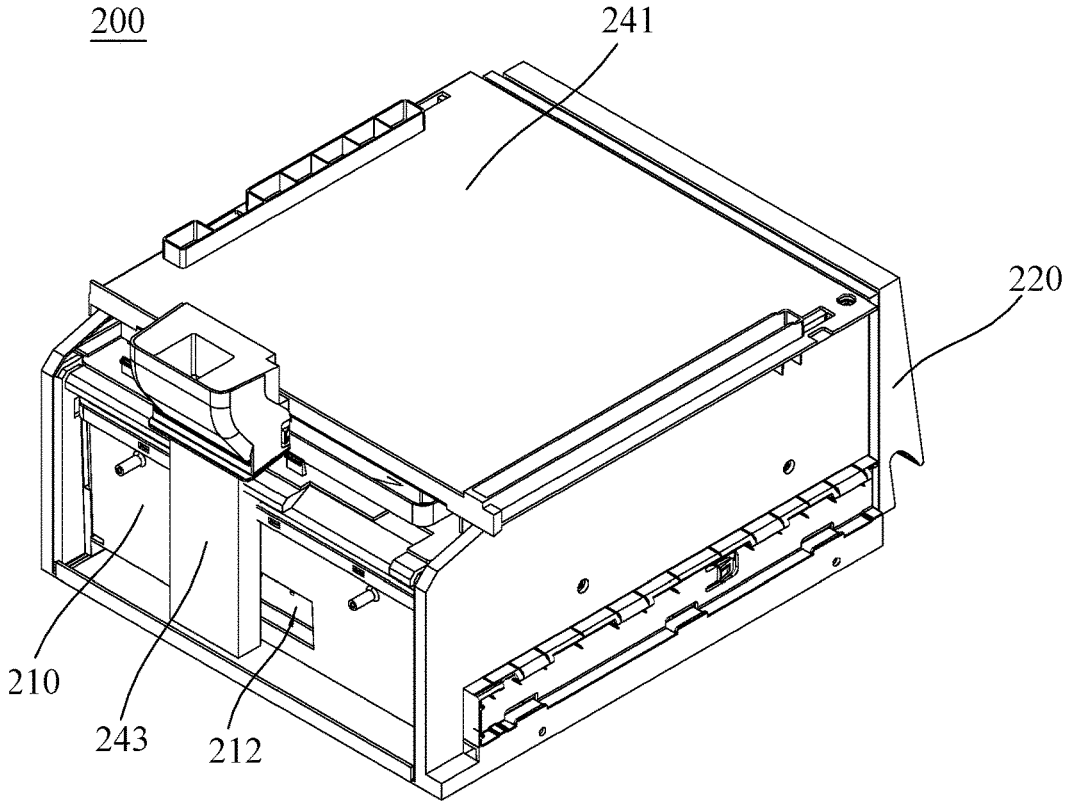
FIG. 3 is a rear upper axonometric view of the magnetic field fresh-keeping apparatus in some embodiments of the present invention.
Figure 4:
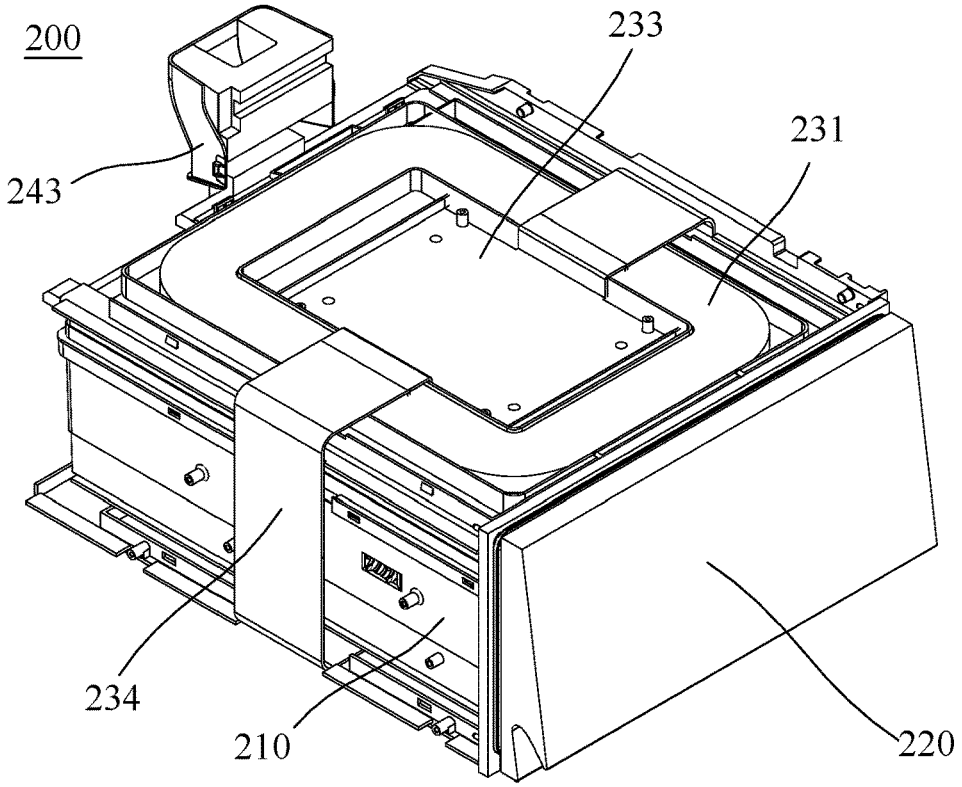
FIG. 4 is a front upper axonometric view of the magnetic field fresh-keeping apparatus in some embodiments of the present invention (top deflector omitted)
Figure 5:
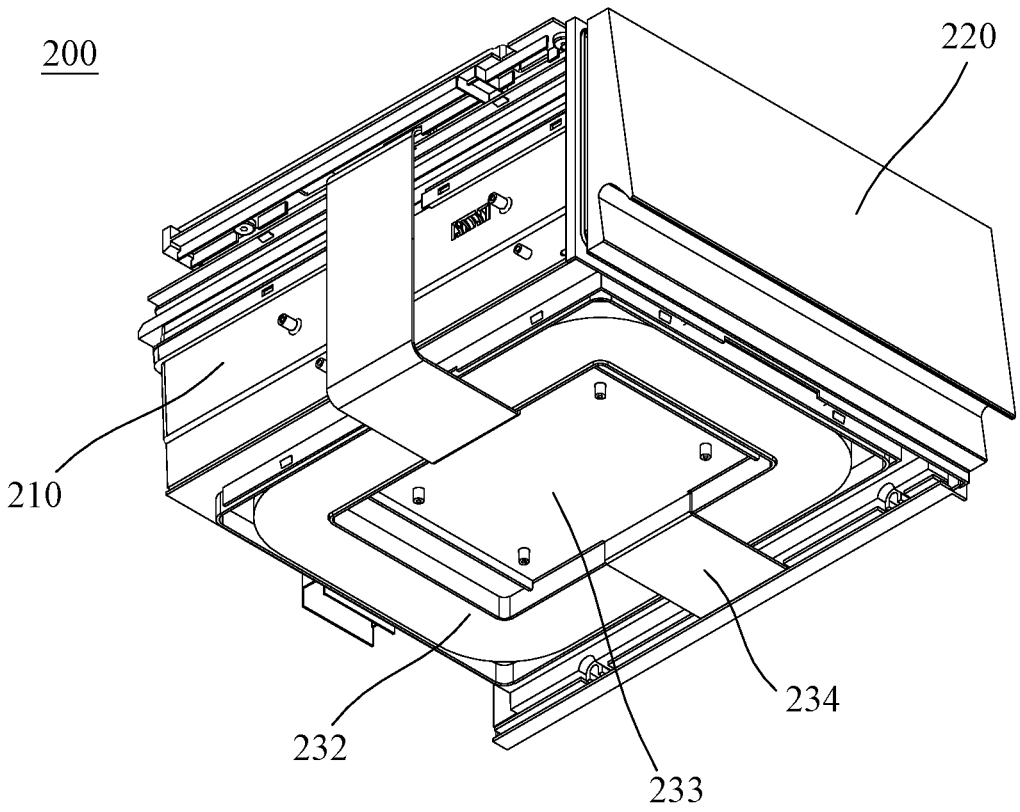
FIG. 5 is a front lower axonometric view of the magnetic field fresh-keeping apparatus in some embodiments of the present invention (bottom deflector omitted)
Figure 6:
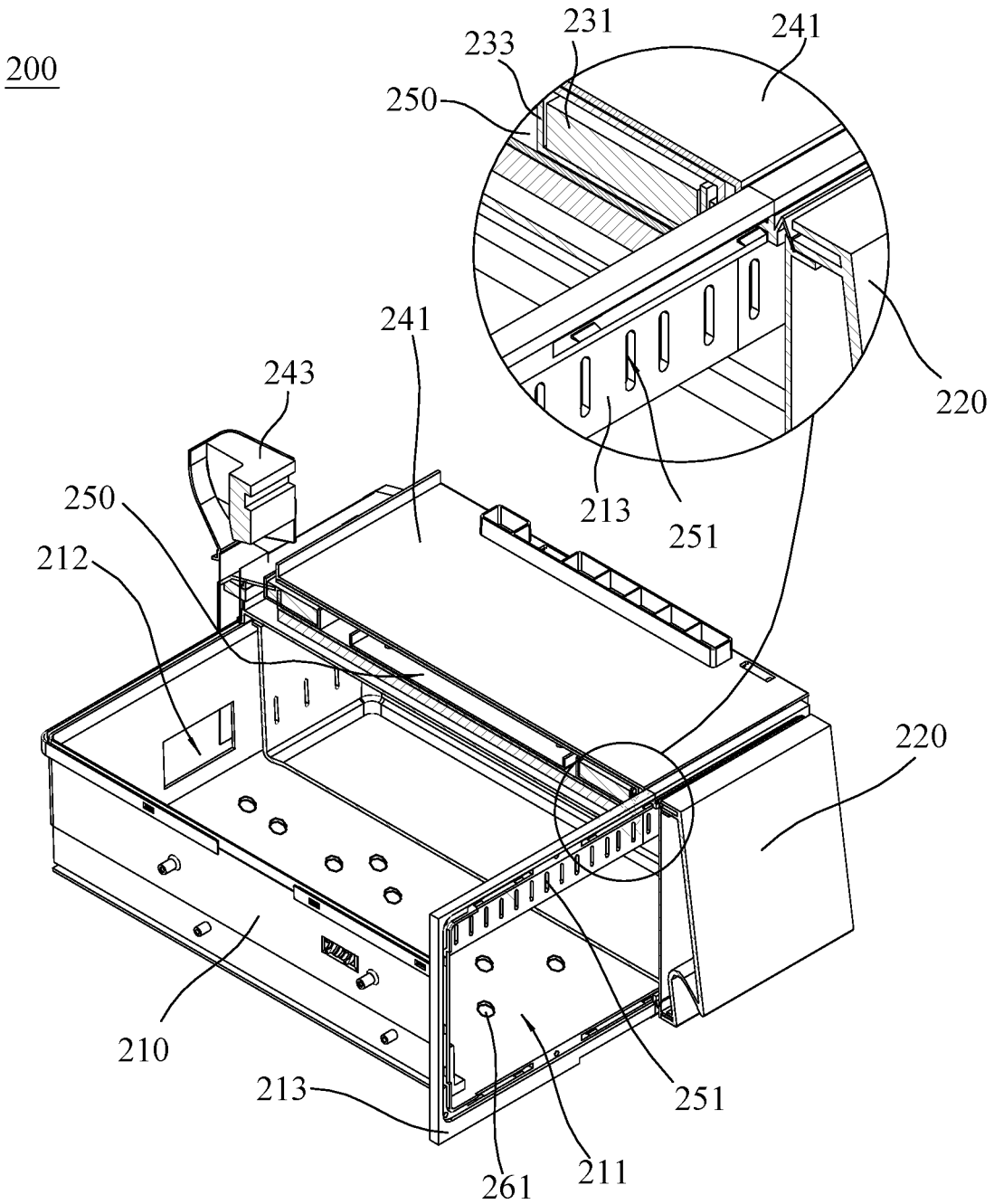
FIG. 6 is a cross-sectional view of the magnetic field fresh-keeping apparatus shown in FIG. 3.

FIG. 3 is a rear upper axonometric view of the magnetic field fresh-keeping apparatus in some embodiments of the present invention; FIG. 4 is a front upper axonometric view of the magnetic field fresh-keeping apparatus in some embodiments of the present invention (top deflector omitted); FIG. 5 is a front lower axonometric view of the magnetic field fresh-keeping apparatus in some embodiments of the present invention (bottom deflector omitted); FIG. 6 is a cross-sectional view of the magnetic field fresh-keeping apparatus shown in FIG. 3.

As shown in FIGS. 2 to 6, an opening 211 is provided at a front side of the drawer container 210 for inserting the drawer 220 into the drawer container 210, so that drawer 220 can be mounted into the drawer container 210 with sliding motion. The drawer container 210 further has an air return opening 212 at a back side thereof, and the air return opening 212 is communicated with the return air channel 130, for drawing air from inside the drawer container 210 into the return air channel 130. In addition, as required, personnel skilled in the art can arrange the air return opening 212 on the left, right, lower or upper side of the drawer container 210.

As shown in FIG. 2, the drawer 220 has a front cover 221, when the drawer 220 slides into the drawer container 210, the front cover 221 contacts the frame 213 at the front of the drawer container 210 (as shown in FIG. 6), and there is a gap between the front cover 221 and the frame 213 at the front end of the drawer container 210.

Figure 7:
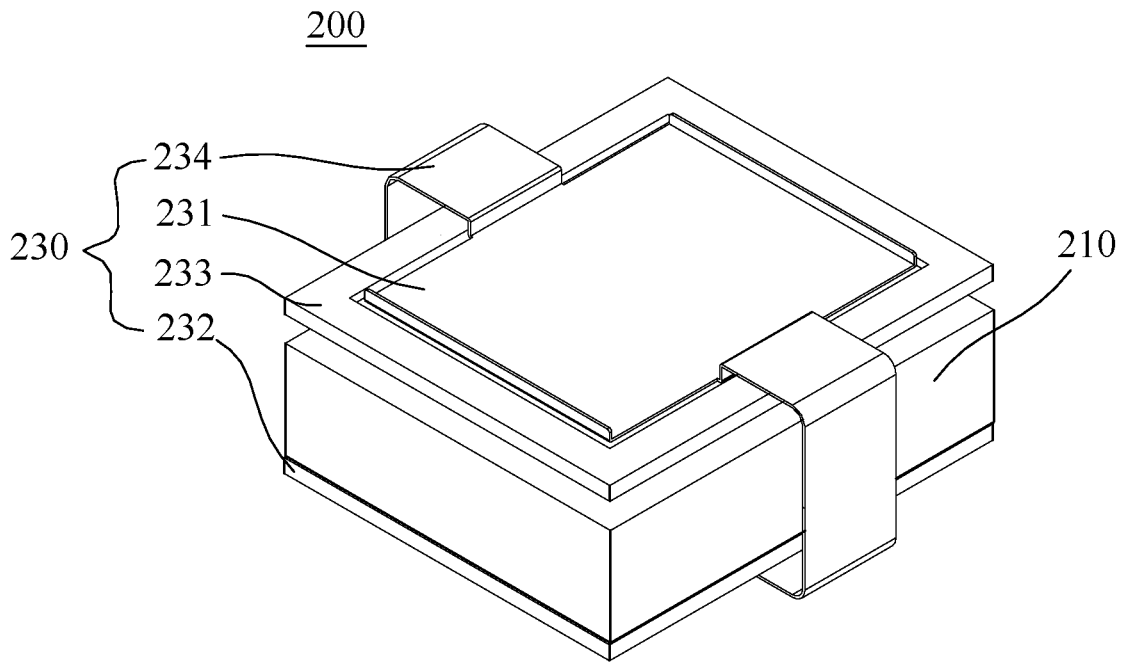
FIG. 7 is schematic diagram of the effect of the magnetic field fresh-keeping apparatus in some embodiments of the present invention.
Figure 8:
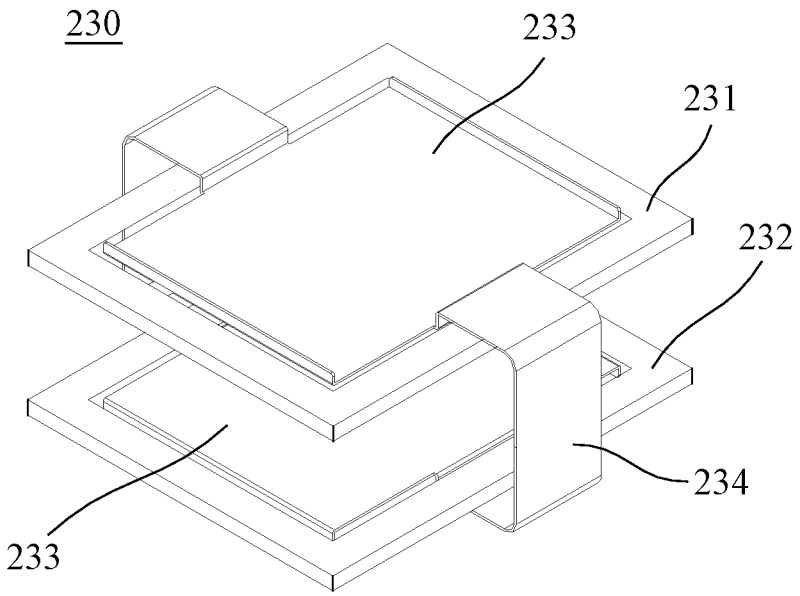
FIG. 8 is an axonometric view of a magnetic field assembly shown in FIG. 7.

FIG. 7 is schematic diagram of the effect of the magnetic field fresh-keeping apparatus in some embodiments of the present invention; FIG. 8 is an axonometric view of a magnetic field assembly shown in FIG. 7.

As shown in FIGS. 2, 4 to 7, the magnetic field assembly 230 is placed outside the drawer container 210 to facilitate the fixing and wiring of the magnetic field assembly 230. Of course, the technician in the art can also arrange the magnetic field assembly 230 on the inside of the drawer container 210 as required.

As shown in FIGS. 2, 4 to 8, the magnetic field assembly 230 comprises a top coil 231 at a top side of the drawer container 210 and a bottom coil 232 at a bottom side of the drawer container 210. Preferably, the top coil 231 and the bottom coil 232 are aligning with each other. Additionally, the magnetic field assembly 230 comprises magnetic guiding elements 233 and a magnetic connection member 234. Preferably, the top coil 231 and the bottom coil 232 are respectively provided with one magnetic guiding element 233, and the two magnetic guiding elements 233 are securely connected together by the magnetic connection member 234. Ideally, the top coil 231, its corresponding magnetic guiding element 233, the bottom coil 232, and its corresponding magnetic guiding element 233 cover the drawer 220 in the direction of the magnetic field, thereby ensuring all stored items are within the magnetic field.

In the present invention, the magnetic guiding elements 233 are used for assisting the top coil 231 and the bottom coil 232 to form a uniform magnetic field within the drawer container 210, thereby providing a good magnetic preservation environment for the items stored in the drawer 220. In addition, the setting of the magnetic guiding elements 233 also facilitates the control of the intensity of the magnetic field formed by the top coil 231 and the bottom coil 232, avoiding the occurrence of too high or too low intensity of the magnetic field in the local area of the drawer 220.

Further, in present invention, the magnetic connection member 234 prevent leakage of the magnetic field from the top and bottom coils 231, 232, that is restricting the magnetic field in the drawer container 210 for maximum effect on the stored items. Therefore, the magnetic field utilization of the top coil 231 and the bottom coil 232 is improved by providing the magnetic guiding elements 233 and the magnetic connection member 234.

It should be noted that, the magnetic guiding elements 233 and the magnetic connection member 234 can be any feasible magnetic materials, such as silicon steel, 45 permalloy, 78 permalloy, super permalloy, etc.

As illustrated in FIGS. 2 to 4 and 6, and the air inlet duct assembly 240 comprises a top deflector plate 241, a bottom deflector plate 242, and a guide duct 243. The top deflector plate 241 is set outside the top coil 231, forming a top air duct 250 with a top wall of the drawer container 210. The bottom deflector plate 242 is set outside the bottom coil 232, forming a bottom air duct 260 with a bottom wall of the drawer container 210. The guide duct 243 is fixed at the rear side of the drawer container 210, and the guide duct 243 has an air inlet communicated with the air supply channel 120 on a top side thereof, and the guide duct 243 further communicates with both the top air duct 250 and the bottom air duct 260. The guide duct 243 directs the cold air from the air supply channel 120 to the top air duct 250 and the bottom air duct 260.

On the premise that the cold air in the air supply channel 120 can be guided to the top air duct 250 and the bottom air duct 260, the technical personnel in the field can also omit the guide duct 243 according to the need. For instance, the top air duct 250 and the bottom air duct 260 can directly communicate with the air supply channel 120, as an example, the magnetic field fresh-keeping apparatus 200 further comprises a sleeve enclosing outside the drawer container 210, the top deflector plate 241, and the bottom deflector plate 242. The sleeve's inner cavity is interconnected with the top and bottom air ducts, with an air inlet on the sleeve communicated with the air supply channel 120.

Further, in other embodiments of the invention, as required, technicians in the field can further set an air door on the outlet of the air supply channel 120, or on the guide duct 243 (specifically near its air inlet), to control whether the cold air from the air supply channel 120 flows to the top and bottom air ducts 250, 260 or to control the speed of the cold air from the air supply channel 120 flowing to the top and bottom air ducts 250, 260.

As shown in FIGS. 2 and 6, the top air duct 250 further communicates with the drawer container 210. Specifically, the top air duct 250 has a top outlet 251 aligned with the front cover 221 of the drawer 220, thereby directing cold air towards the front cover 221 and then redirecting it into the drawer 220. More specifically, the top outlet 251 is formed on the front frame 213 of the drawer container 210.

As shown in FIG. 2, the bottom air duct 260 further communicates with the drawer container 210. Specifically, the bottom air duct 260 has a bottom outlet 261 formed on the bottom wall of the drawer container 210. The bottom air duct 260 directs cold air through the bottom outlet 261 onto the bottom wall of the drawer 220.

From the aforementioned description, those skilled in the field can understand that the magnetic field fresh-keeping apparatus 200 of the present invention prevents direct cold air blowing onto the stored items in the drawer 220, thereby avoiding freezing of the stored items. Moreover, the presence of the magnetic field assembly 230 significantly influences the formation of ice crystals during freezing, lowering the freezing temperature of the stored items. This allows the items to be preserved at lower temperatures without freezing. Thus, the air-cooled refrigeration device and the magnetic field fresh-keeping apparatus 200 of this invention effectively prevent the freezing of stored items.

Figure 9:
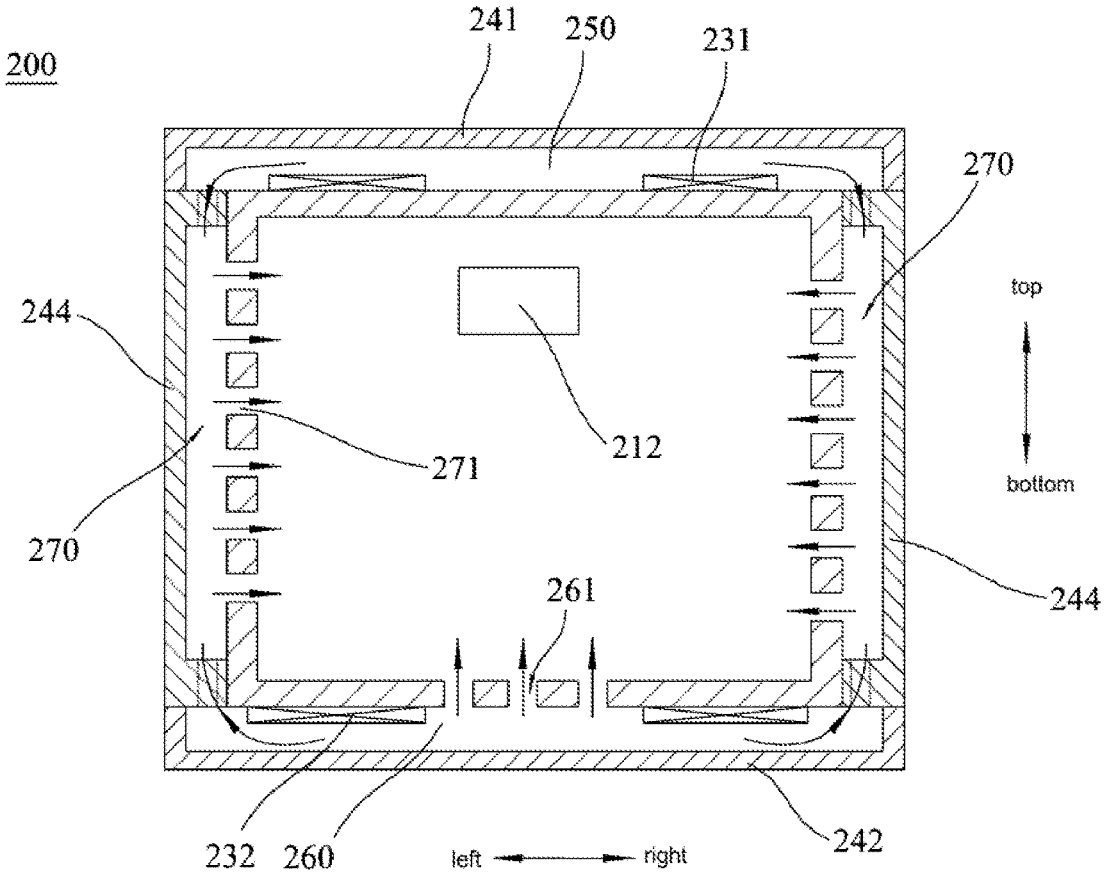
FIG. 9 is a schematic diagram of an air inlet duct assembly in some embodiments of the present invention.

FIG. 9 is a schematic diagram of an air inlet duct assembly 240 in some embodiments of the present invention.

In these embodiments, the air inlet duct assembly 240 further comprises at least one side deflector plate 244 set on at least one side of the drawer container 210.

Preferably, as shown in FIG. 9, a pair of side deflector plates 244 are disposed on both sides of the drawer container 210. A side air duct 270 is formed between each side deflector plate 244 and the corresponding side wall of the drawer container 210, and the side air ducts 270 communicate with the top air duct 250 and/or the bottom air duct 260. Furthermore, each side air duct 270 has a plurality of side outlets 271 formed on the relative side wall of the drawer container 210, thereby directing cold air through the side outlets 271 onto the side walls of the drawer 220.

Figure 10:
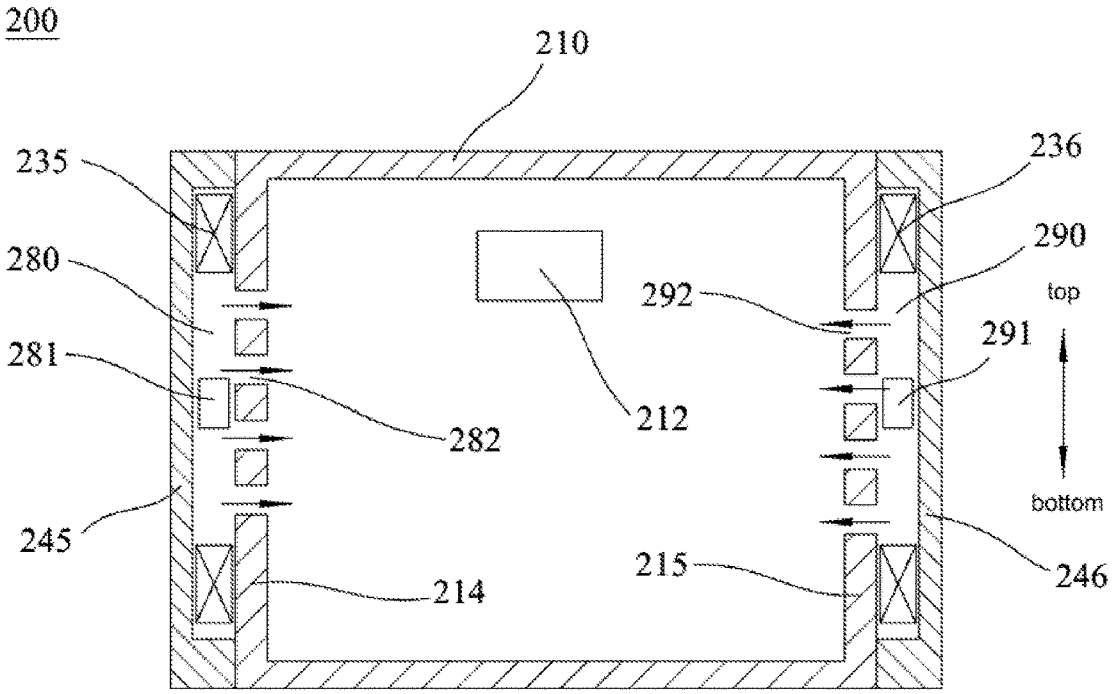
FIG. 10 is a schematic diagram of the air inlet duct assembly in other embodiments of the present invention.

FIG. 10 is a schematic diagram of the air inlet duct assembly in other embodiments of the present invention.

In these embodiments, the magnetic field assembly 230 is disposed outside the drawer container 210 and comprises a left coil 235 and a right coil 236. The left coil 235 is positioned on the left side of the drawer container 210, and the right coil 236 is positioned on the right side.

Further, the air inlet duct assembly 240 comprises left and right deflector plates 245, 246. The left deflector plate 245 is placed outside the left coil 235 and forms a left-side air duct 280 with a left wall 214 of the drawer container 210, the left-side air duct 280 is communicated with the drawer container 210. Similarly, the right deflector plate 246 is placed outside the right coil 236 and forms a right-side air duct 290 with a right wall 215 of the drawer container 210, and the right-side air duct 290 is communicated with the drawer container 210.

Preferably, the left-side air duct 280 has a left-side air inlet 281 and a plurality of left-side air outlets 282. Cold air enters the left-side air duct 280 through the left-side air inlet 281 and exits through the left-side air outlets 282. The left-side air outlets 282 are formed on the left wall 214 of the drawer container 210 and aligned with the side panel of the drawer 220, thereby directing cold air towards the side panel of the drawer 220, thus avoiding direct cold air blowing onto the stored items in the drawer 220.

Similarly, the right-side air duct 290 has a right-side air inlet 291 and a plurality of right-side air outlets 292. Cold air enters through the right-side air inlet 291 and exits through the right-side air outlets 292. The right-side air outlets 292 is formed on the right wall 215 of the drawer container 210 and aligned with the side panel of the drawer 220, thereby directing cold air towards the side panel of the drawer 220, thus avoiding direct cold air blowing onto the stored items in the drawer 220.

Optionally, the air inlet duct assembly 240 can further include an air inlet pipe with one air inlet and two air outlets. The air inlet pipe is communicated with the air supply channel 120 at the air inlet and communicated with the left-side air inlet 281 and right-side air inlet 291 at the two air outlets.

Additionally, technical professionals can, if necessary, configure magnetic guiding components for the left coil 235 and right coil 236 to help form a uniform magnetic field inside the drawer container 210, thereby providing a balanced magnetic preservation environment for the stored items in the drawer 220.

Further, one magnetic connection member can be provided for the magnetic guiding elements corresponding to the left coil 235 and right coil 236, thereby connecting the two magnetic guiding elements together. The combination of the magnetic guiding elements and magnetic connection member can restrict the magnetic field generated by the left coil 235 and right coil 236 within the drawer container 210, thereby ensuring the magnetic field effectively acts on the stored items in the drawer 220. Therefore, the present invention enhances the utilization rate of the magnetic fields generated by the left coil 235 and right coil 236 through the setting of magnetic guiding elements and magnetic connection member.

Figure 11:
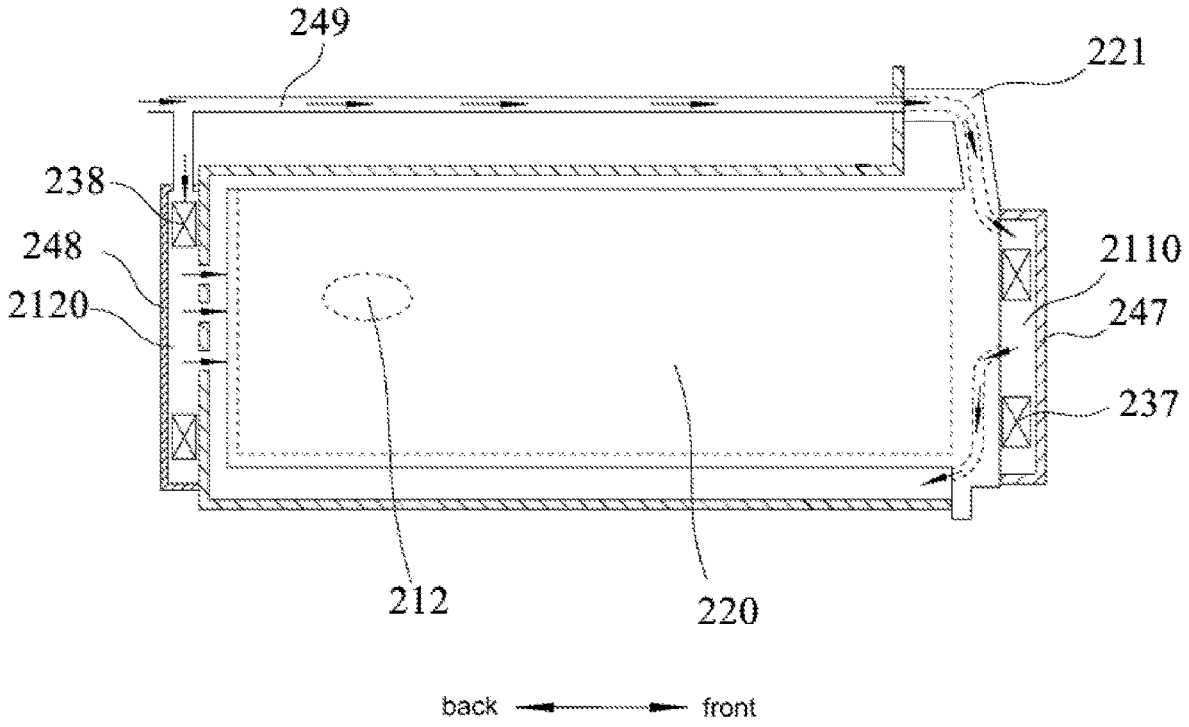
FIG. 11 is a schematic diagram of the air inlet duct assembly in another embodiments of the present invention.

FIG. 11 is a schematic diagram of the air inlet duct assembly in another embodiments of the present invention.

In these embodiments, the magnetic field assembly 230 is located outside the drawer container 210, and comprises a front coil 237 and a rear coil 238. The front coil 237 is positioned on the front cover 221 of the drawer 220, while the rear coil 238 is on the rear side of the drawer container 210.

In further, the air inlet duct assembly 240 comprises front and rear deflector plates 247, 248 and a drainage conduit 249. The front deflector plate 247 is arranged outside of the front coil 237 and a front side air duct 2110 is formed between the front cover 221 of the drawer 220 and the front deflector plate 247. The rear deflector plate 248 is arranged outside of the rear coil 238 and a rear side air duct 2120 is formed between a rear wall of the drawer 220 and the rear deflector plate 248.

In further, the front side air duct 2110 and the rear side air duct 2120 are communicated with the air supply channel 120 through the drainage conduit 249.

Additionally, the front cover 221 of the drawer 220 is provided with a first drainage channel (shown as the double dashed lines on an upper part of the front cover 221 in FIG. 11) for connecting the front side air duct 2110 with the drainage conduit 249, the front cover 221 is further provided with a second drainage channel (shown as the double dashed lines on a lower part of the front cover 221 in FIG. 11) for connecting the front side air duct 2110 with a cavity of the drawer container 210. The front wall of the rear side air duct 2120 has an outlet. Optionally, the air return opening 212 can be located on the left, right, or top wall of the drawer container 210.

In the implementation shown in FIG. 11, with the action of the drainage conduit 249, the cold air provided by the air supply channel 120 partially flows towards the front side air duct 2110 for cooling the front coil 237, and into the drawer container 210. Another part flows towards the rear side air duct 2120 for cooling the rear coil 238, and into the drawer container 210.

So far, it should be appreciated by those skilled in the art that while various exemplary embodiments of the invention have been shown and described in detail herein, many other variations or modifications which are consistent with the principles of this invention may be determined or derived directly from the disclosure of the present invention without departing from the spirit and scope of the invention. Accordingly, the scope of the invention should be understood and interpreted to cover all such other variations or modifications.

What is claimed is:

1. A magnetic field fresh-keeping apparatus capable of preventing direct blowing of cold air, applied to an air-cooled refrigeration device, comprising:

a drawer container with an opening on a front side thereof;

a drawer mounted in the drawer container in a slidable manner;

a magnetic field assembly for providing a magnetic field to stored items inside the drawer;

an air inlet duct assembly configured to enable cold air to first cool the magnetic field assembly, and then enter the drawer container in a manner of not directly blowing the stored item;

an air return opening formed on the drawer container for discharging air in the drawer container, wherein the magnetic field assembly is located outside the drawer container and comprises front and rear coils, and the front coil is located on a front cover of the drawer and the rear coil is located on a rear side of the drawer container, and wherein the air inlet duct assembly comprises:

a front deflector plate covering the outside of the front coil and forming a front-side air duct between it and the front cover of the drawer, and the front-side air duct communicated with the drawer container; and a rear deflector plate covering the outside of the rear coil and forming a rear-side air duct between it and the rear wall of the drawer container, and the rear-side air duct communicated with the drawer container.

2. An air-cooled refrigeration device, comprising: a magnetic field-based fresh-keeping storage container according to claim 1.

* * * * *